US006715399B2

(12) United States Patent
Barrett, Jr.

(10) Patent No.: US 6,715,399 B2
(45) Date of Patent: Apr. 6, 2004

(54) FIREARM BOLT ASSEMBLY

(76) Inventor: Rolin F. Barrett, Jr., 5132 Killarney Hope Dr., Raleigh, NC (US) 27613

( * ) Notice: Subject to any disclaimer, the term of this patent is extended or adjusted under 35 U.S.C. 154(b) by 10 days.

(21) Appl. No.: 10/075,435

(22) Filed: Feb. 14, 2002

(65) Prior Publication Data

US 2003/0150322 A1 Aug. 14, 2003

(51) Int. Cl.[7] ..... F41A 3/00
(52) U.S. Cl. ..... 89/182; 89/187.02; 89/198
(58) Field of Search ..... 89/182, 187.02, 89/198, 1.703, 183; 42/1.06

(56) References Cited

U.S. PATENT DOCUMENTS 1,073,908 A * 9/1913 Kiraly et al. ..... 89/190
2,921,502 A * 1/1960 Amsler ..... 89/149
3,738,219 A * 6/1973 Febres ..... 89/1.703
3,848,510 A * 11/1974 Wolpert ..... 89/173
3,998,126 A * 12/1976 Rudd ..... 89/184
4,194,433 A * 3/1980 Zellweger et al. ..... 89/190
4,938,116 A * 7/1990 Royster ..... 89/198
5,682,007 A * 10/1997 Dobbins ..... 89/187.02
5,900,576 A * 5/1999 Gabriel ..... 89/187.01

* cited by examiner

*Primary Examiner*—Michael J. Carone
*Assistant Examiner*—M. Thomson
(74) *Attorney, Agent, or Firm*—Coats & Bennett, P.L.L.C.

(57) ABSTRACT

A firearm includes a moveable bolt assembly that absorbs energy associated with the discharge of the firearm. An energy absorbing mechanism within the bolt assembly may include a dampening spring that provides recoil energy dissipation. With this arrangement, one or more actuators may be provided that are operative to compress the dampening spring with respect to the bolt assembly in response to the discharge of the firearm.

20 Claims, 4 Drawing Sheets

FIREARM BOLT ASSEMBLY

BACKGROUND OF THE INVENTION

The present invention relates to the field of firearms, and particularly energy absorbing mechanisms carried within bolt assemblies.

Discharging a firearm results in an explosion, which not only propels a bullet through and out a barrel, but also generates an opposite reactive force termed "recoil." Recoil is objectionable, in part, due to the uncomfortable force that is exerted on a user, and therefore must be managed effectively. One approach uses the recoil energy to propel a large heavy mass, conventionally configured as a bolt assembly, toward the rear of the weapon. The bolt assembly typically engages and compresses a recoil spring, to which the bolt assembly transfers its kinetic energy, thereby decelerating the bolt assembly and dissipating energy.

The use of a heavy bolt assembly to manage recoil necessitates the need for a substantial recoil spring in order to effectively absorb the kinetic energy carried rearward by the heavy bolt assembly. While this approach dissipates energy, it may not dissipate enough of the energy to render the recoil less objectionable to a shooter. Additionally, this approach to managing recoil increases the weight of the weapon. What is needed is a method of managing recoil that does not require a large, heavy bolt assembly.

BRIEF SUMMARY OF THE INVENTION

The present invention entails a firearm having a barrel and a moveable bolt assembly disposed adjacent the barrel. An energy-absorbing mechanism is carried by the bolt assembly and includes a dampening spring. The firearm includes at least one actuator that is operative to compress the dampening spring with respect to the bolt assembly in response to a firing of the firearm.

In another embodiment of the present invention, a bolt assembly is provided and includes a housing. A dampening spring is associated with the bolt assembly housing and is carried thereby. Further, the bolt assembly housing includes a moveable actuator and a head moveably retained between the dampening spring and the actuator. Movement of the actuator displaces the head relative to the bolt assembly housing, thereby compressing the dampening spring.

Further, the invention entails a method of dissipating recoil energy in a firearm. This method entails displacing an actuator retained by a moveable bolt assembly and translating the actuator displacement into a compressive force, and directing the compressive force to a dampening spring carried within the bolt assembly.

DETAILED DESCRIPTION OF THE INVENTION

Exemplary embodiments of the present invention are discussed in the context of a rifle. Those skilled in the art will recognize that the present invention applies to a wide variety of firearms, including, but not limited to, handguns, sporting weapons, and military arms.

Figure 1:
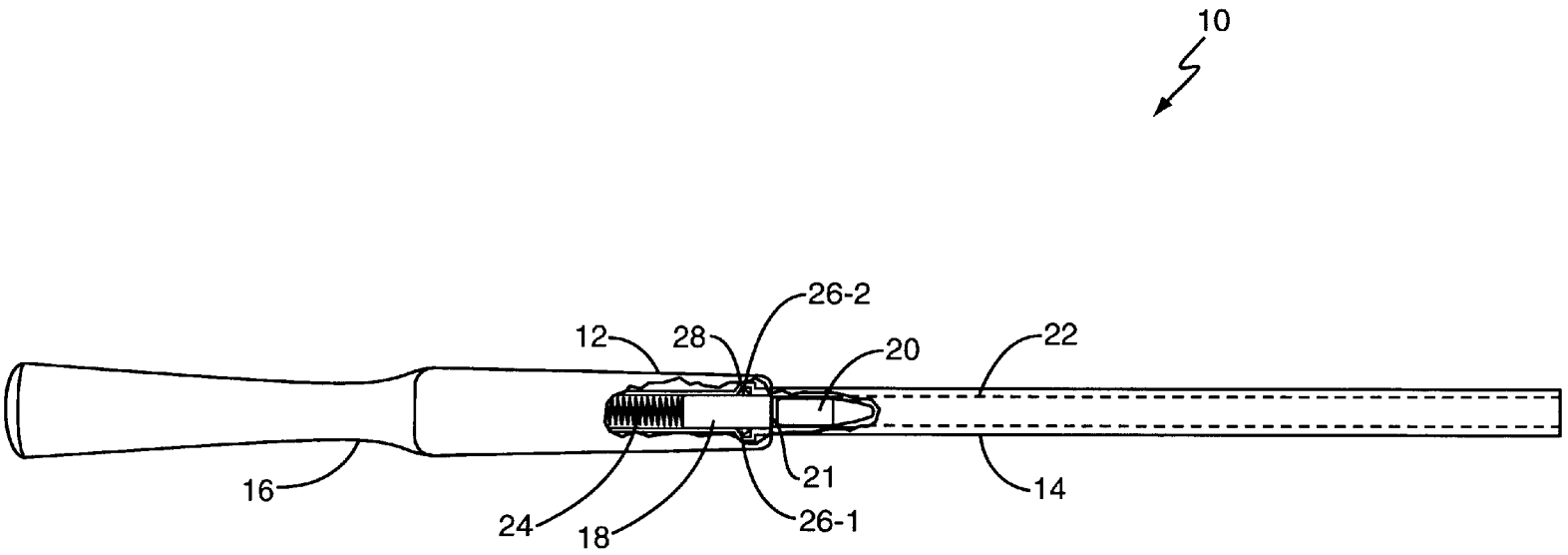
FIG. 1 is a cut-away view of a rifle-type firearm displaying one embodiment of the present invention.

Referring to FIG. 1, a firearm 10 comprises a receiver 12, a barrel 14, a stock 16 and a bolt assembly 18. The bolt assembly 18 is moveable within the receiver 12, also referred to as a "firearm housing," and initiates a "firing cycle" by seating a cartridge 20 into a chamber area 21 of the barrel 14. The bolt assembly 18 carries a firing pin assembly (not shown) that strikes the cartridge 20 and discharges the firearm 10.

Upon discharge, the explosive force of the cartridge, termed recoil, propels the bullet through the bore 22, and moves the bolt assembly 18 rearward within the receiver 12. This recoil motion causes the bolt assembly 18 to engage and compress a recoil spring 24 positioned behind the bolt assembly 18. Compression of the recoil spring 24 dissipates a portion of the firing energy and lessens the recoil force imparted to the shooter. Subsequent expansion of the recoil spring returns the bolt assembly 18 to its pre-discharge position, thus completing the "firing cycle." Those skilled in the art will appreciate that the present invention is not limited to those weapons that rely solely on the recoil spring 24 to return the bolt assembly 18 to its pre-discharge position. The present invention may be applied in weapons that utilize alternate methods to move the bolt, including, but not limited to, various gas-assisted techniques.

One or more actuators 26, shown here as 26-1 and 26-2, may retard the movement of the bolt assembly 18 during recoil, which actuators in this embodiment, are carried by the bolt assembly 18. Prior to discharge, the actuators 26 assume "locked" positions within one or more actuator recesses 28, shown here as 28-1 and 28-2. The actuator recesses 28 are generally present in the interior of the receiver 12 and may be aligned with internal guides along which the actuators 26 travel. The recoil movement of the bolt assembly 18 causes the actuators 26 to press against an internal portion of the actuator recesses 28. This engagement of the actuators 26 against the rearward faces of the actuator recesses 28 displaces the actuators 26 from the "locked" position to an "unlocked" position and generally requires the recoil force to overcome a mechanical disadvantage, imparted here by the rearward face angle, thereby retarding the rearward movement of the bolt assembly 18.

Figure 2:
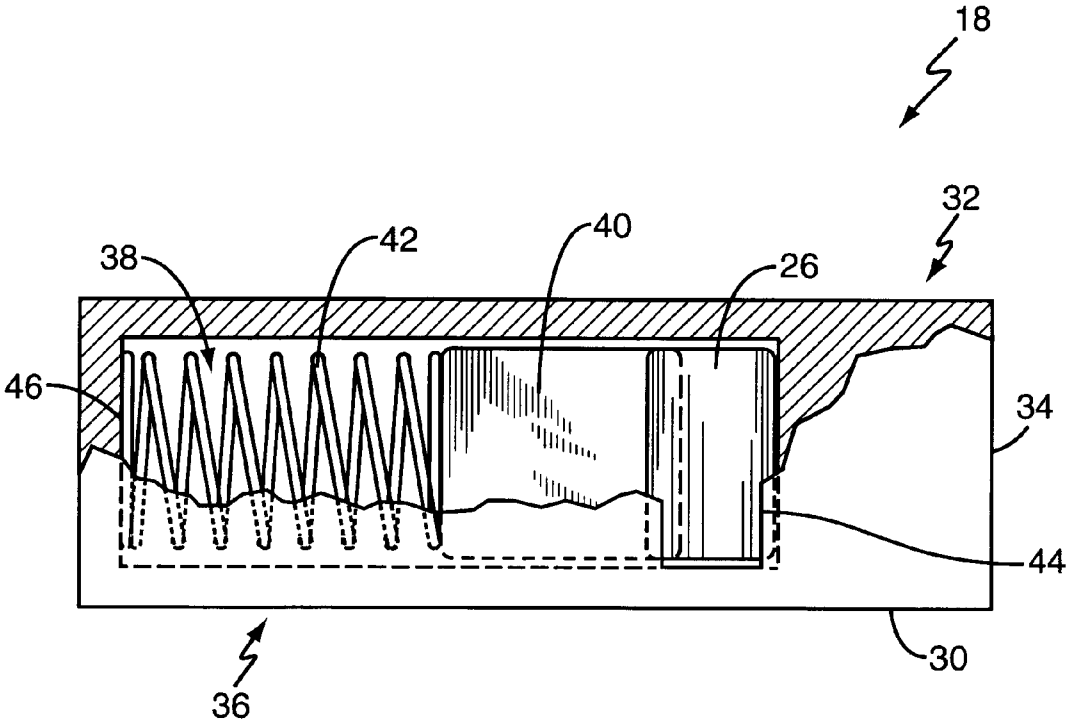
FIG. 2 is a side elevational view of a bolt assembly in one embodiment of the present invention with portions of the housing of the bolt assembly being broken away to illustrate the internal structure thereof.

FIG. 2 illustrates a simplified but exemplary embodiment of the bolt assembly 18, which includes a bolt assembly housing 30, also referred to as a "bolt" 30. The bolt 30 comprises a front portion 32, including a face 34 for engaging a cartridge 20, and a rear portion 36 defining a cavity 38. An energy absorbing mechanism, here comprising a head 40 and a dampening spring 42, is carried within the cavity 38 and absorbs some portion of recoil energy.

Prior to firing, the bolt assembly 18 is in its forward or locked position within the receiver 12. The dampening spring 42 engages the head 40, which, in turn, engages at least one of the actuators 26. The force exerted by the dampening spring 42 on the head 40 causes the head 40 to bias the actuators 26 outward, so that they partially protrude through openings 44 formed in the bolt 30, and seat within the actuator recesses 28. The openings 44 are, in at least one embodiment, sized relative to the actuators 26 such that each actuator 26 can project partially through its corresponding opening 44, but is too big to pass completely through the opening 44. For example, the width of an opening 44 can be set as some fraction of the diameter or cross section of the corresponding actuator 26. By fixing the size of openings 44 appropriately, the bolt assembly 18 is operative to movably retain one or more actuators 26 between locked and unlocked positions.

It should be understood that the number of openings 44 varies with the number and arrangement of actuators 26 used in a given design. In general, the one or more openings 44 are formed to match the actuator shape and bolt design needed in a particular application. Further, the location of the one or more openings 44 on the bolt 30 may be varied as needed.

Upon discharge, the actuators 26 are displaced, as described above. Displacing the actuators 26 during recoil moves the head 40 downward and compresses the dampening spring 42. Thus, the displacement of the actuators 26 translates into a compressive force directed into the dampening spring 42 and results in the absorption of some portion of the recoil energy.

This translation of movement may be accomplished with varying configurations and numbers of actuators 26. As an aid to understanding, one, two, or more, actuators 26 may be implemented as cylindrical pins, rollers or spheres. However, it should be understood that they are in no way limited to those shapes. In general, the engaging surfaces of the head 40 and those of the one or more actuators 26 are designed in complementary fashion, depending on the specific implementation.

Figure 3B:
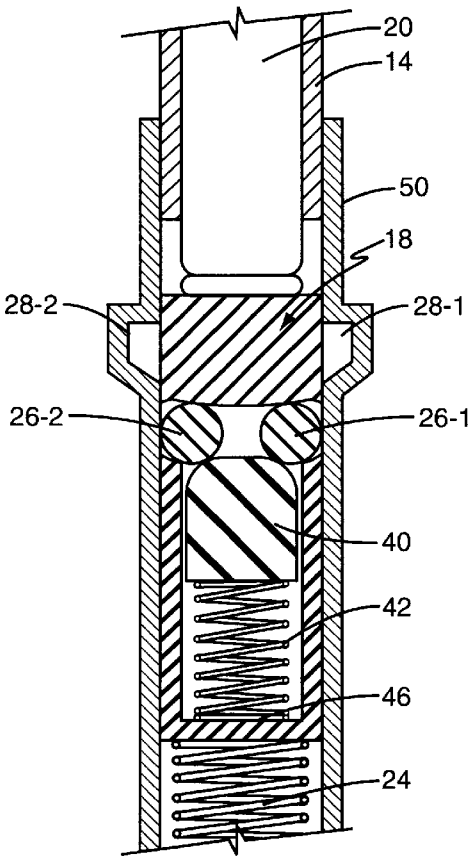
FIG. 3B is a diagram of the bolt assembly of FIG. 3A with the actuators in the unlocked position.
Figure 3A:
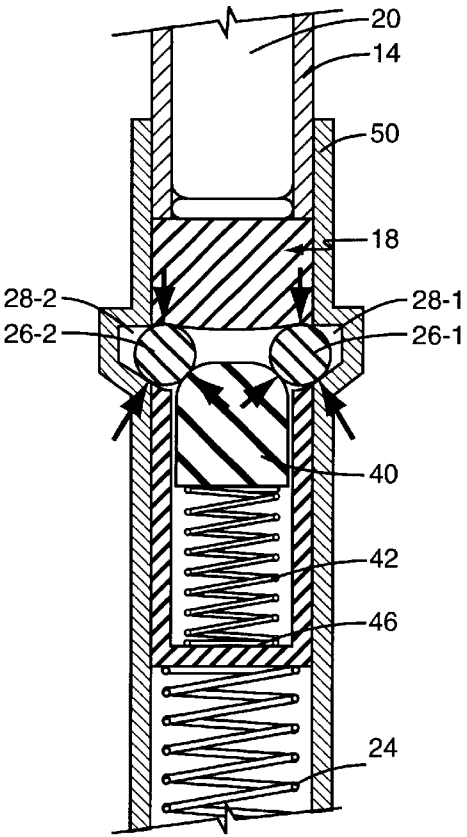
FIG. 3A is a diagram of an exemplary embodiment of the bolt assembly with the actuators in the locked position.

FIGS. 3A and 3B illustrate an exemplary embodiment that uses two actuators 26-1 and 26-2, arranged in a generally transverse alignment relative to the bolt assembly 18. FIG. 3A depicts the bolt assembly 18 within the receiver 12 at the beginning of a "firing cycle." Note that each actuator, 26-1 and 26-2, occupies opposite positions on either side of the forward portion of the head 40. Further, each of the actuators 26-1 and 26-2, are seated in a corresponding one of the actuator recess 28-1 and 28-2, assuming the "locked" position. The forward portion of the head 40 is formed as a generally arcuate surface, permitting rolling or sliding engagement of the head 40 by the actuators 26.

One end of the dampening spring 42 is engaged with the head 40 while the opposing end is engaged with the rear wall 46. As noted earlier, the dampening spring 42 exerts a biasing force on the head 40, causing it to push or otherwise bias the actuators 26-1 and 26-2 outward such that they at least partially project from the openings 44 formed within the bolt 30. This biasing force seats the actuators 26-1 and 26-2 within the corresponding actuator recesses 28-1 and 28-2, present in the receiver's inner wall 50. Solid arrows in the drawings indicate the biasing force, as well as other forces exerted by various elements, acting on the actuators 26. Upon firing, recoil movement of bolt assembly 18 forces the actuators 26 from the recesses 28 and presses the actuators 26 inward relative to the bolt assembly 18.

FIG. 3B illustrates the displacement of the actuators 26 into the "unlocked" position by the recoil movement of the bolt assembly 18. The recoil energy must overcome the mechanical disadvantage imparted by the angled engaging faces of the actuator recesses 28 to move the bolt assembly 18 rearward within the receiver 12. Overcoming this disadvantage initially retards the recoil movement of the bolt assembly 18 and dissipates some portion of the recoil energy. The actuator displacement translates into a compressive movement by the head 40, which compresses the dampening spring 42 and thereby absorbs some additional portion of the recoil energy. Upon the recoil spring 24 returning the bolt assembly 18 to its pre-discharge position within the receiver 12, the dampening spring 42 expands, thereby forcing the actuators 26 into their locked positions within the actuator recesses 28, thus completing the "firing cycle."

The present invention may be used with varying arrangements of elements. Another embodiment illustrated in FIGS. 4A and 4B uses a pair of asymmetrically aligned actuators 26. Note that the inner receiver wall 50 has been modified to align the actuator recesses 28 accordingly, and only one of the actuators 26 engage the head directly, while both of the actuators 26 engage each other. The front portion of the head 40 is generally curved with this arrangement and FIG. 4A illustrates that the dampening spring 42 still exerts a biasing force on the head 40 that seats the actuators 26 in the actuator recesses 28 prior to firing.

Figure 4B:
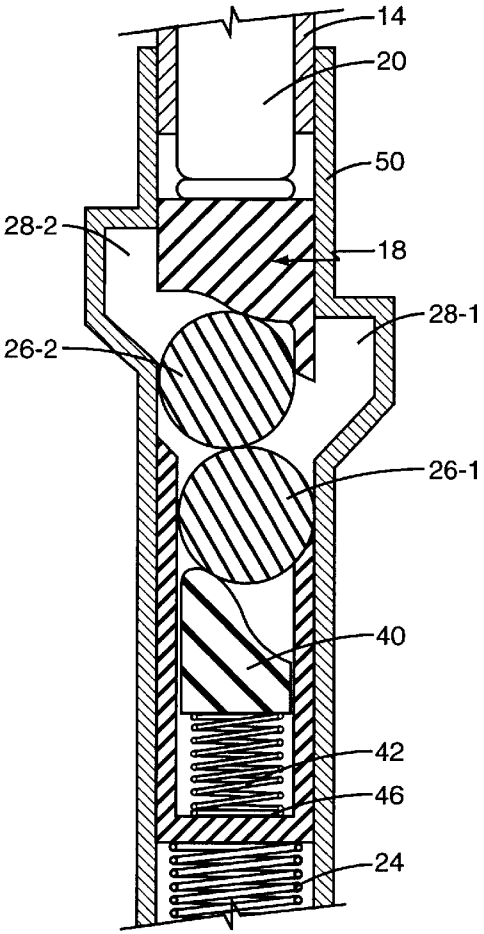
FIG. 4B is a diagram of the bolt assembly of FIG. 4A with the actuators in the unlocked position.
Figure 4A:
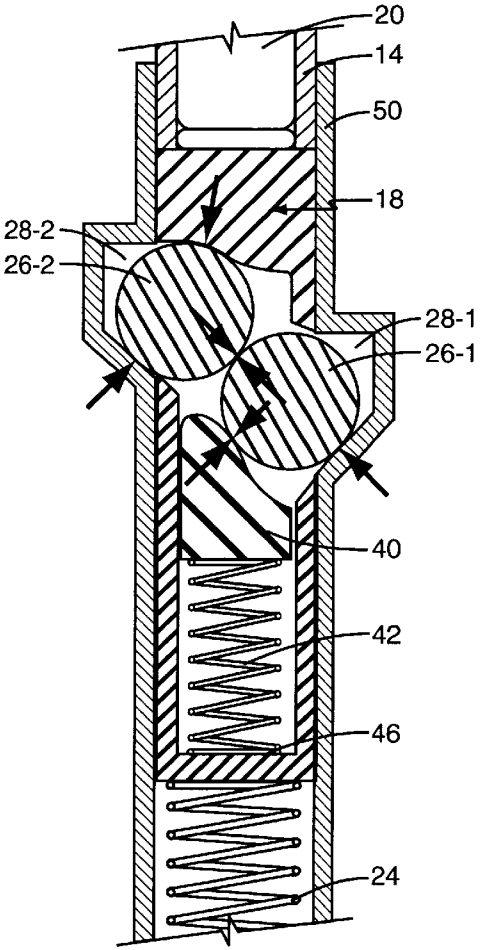
FIG. 4A is a diagram of an alternate embodiment of the bolt assembly with the actuators in the locked position.

FIG. 4B illustrates the recoil action of firearm 10, where rearward movement of the bolt assembly 18 causes the actuators 26 to engage the actuator recesses 28 and move inwardly towards the head 40. In this drawing, actuator 26-1 is displaced inwardly and contacts the head 40. Actuator 26-2 is also displaced, engaging actuator 26-1 and pushing it downward toward the head 40. This action pushes the head 40 downwards and compresses the dampening spring 42. Therefore, regardless of the physical arrangement within the bolt assembly 18, the actuator displacement is translated into a compressive force imparted to the head 40 that compresses the dampening spring 42 and absorbs recoil energy.

Briefly reviewing the operation of the firearm 10 of the present invention, upon discharging a cartridge, pressure from the propellant gases pushes the cartridge case rearward into engagement with the face 34 of the bolt assembly 18. Pressure from the cartridge case tends to move the bolt assembly 18 rearward within the firearm 10. However, rearward movement of the bolt assembly 18 is initially retarded or delayed by one or more actuators. Here, actuators 26-1 and 26-2 provide the retarding function. Prior to firing, the actuators 26-1 and 26-2 assume locked positions. That is, the actuators 26-1 and 26-2 project from the bolt assembly 18 into the recesses 28-1 and 28-2. Thus, the engagement of the actuators 26-1 and 26-2 effectively retards the rearward movement of the bolt assembly 18. However, the pressure associated with the propellant gases will be effective to move the bolt assembly rearward, and as the bolt assembly moves rearward, the rear angle walls of the recesses 28-1 and 28-2, as viewed in FIG. 3A, for example, are effective to push or urge the actuators 26-1 and 26-2 into further engagement with the head 40. This engagement will effectively move the head 40 rearward with respect to the bolt assembly 18. In the process, the dampening spring 42 will be compressed with respect to the bolt assembly 18. Thus, the dampening spring 42 effectively absorbs or dissipates a portion of the energy associated with the propellant gases. In addition, in some embodiments, the recoil spring of 24 can serve to absorb to dissipate an additional portion of the energy associated with the propellant gases.

The previous discussion has been in terms of a firearm 10 using a bolt assembly 18. The embodiments used for illustration include a dampening spring 42 and a head 40, which, here, constitute an energy absorbing mechanism to absorb recoil energy. Not all embodiments are limited to the structure described, however. Those skilled in the art will readily appreciate that, although one dampening spring 42 is illustrated throughout, multiple dampening springs 42 may be used. Multiple actuators and actuator shapes and placements may be used as well without departing from the scope of the invention.

What is claimed is:

1. A firearm comprising:

a firearm housing;

a barrel;

a bolt assembly movable contained within the firearm housing and movable back and forth therein, the bolt assembly disposed generally adjacent the barrel;

a recoil spring engaged with the bolt assembly and disposed adjacent one end of the bolt assembly opposite the barrel such that the bolt assembly moves back and forth between the barrel and the recoil spring;

the bolt assembly including at least one dampening spring and a head engaged with the dampening spring, the dampening spring and head movable back and forth with the bolt assembly, and wherein the head is movable with respect to the bolt assembly;

the dampening spring being positioned between the recoil spring and the barrel;

at least one actuator associating with the bolt assembly and engaged with a portion of the firearm housing for retarding movement of the bolt assembly in response to a firing;

wherein the actuator is disposed adjacent the head such that in response to the firing, the actuator is urged into engagement with the head causing the head to compress the dampening spring and absorbing some of the energy associated with the firing; and wherein the recoil spring is also compressed by the bolt assembly in response to the firing.

2. The firearm of claim 1 wherein the actuator is moveable from an outer locked position where the actuator locks the bolt assembly to an inner unlocked position where the actuator is operative to compress the dampening spring.

3. The firearm of claim 2 wherein the firearm housing at includes at least one actuator recess for receiving the actuator when the actuator assumes the locked position.

4. The firearm of claim 3 wherein the actuator is carried by the bolt assembly, and wherein the movement of the bolt assembly moves the actuator from an outer locked position to an inner unlocked position.

5. The firearm of claim 3 wherein the actuator recess includes an angled surface for engaging the actuator and urging the actuator towards the unlocked position in response to a firing and wherein as the actuator moves towards the unlocked position, the actuator is operative to compress the dampening spring.

6. The firearm of claim 5 wherein the head is interposed between the actuator and the dampening spring and wherein as the actuator moves from the locked position, the actuator engages the head and causes the dampening spring to compress.

7. The firearm of claim 6 wherein both the actuator and the head include generally arcuate shaped contact surfaces.

8. The firearm of claim 7 including a pair of spaced-apart, transversally aligned actuators and wherein the firearm housing includes a pair of actuator recesses for receiving the pair of actuators; and wherein, in response to a firing, both actuators are urged from the locked position to engage the head and compress the dampening spring.

9. The firearm of claim 1 wherein the bolt assembly includes a head portion, a rear wall, a pair of side walls, and a cavity defined by the head portion, rear wall and side walls for receiving the dampening spring.

10. The firearm of claim 9 with wherein the dampening spring and head are disposed at least partially within the cavity.

11. The firearm of claim 1 including a pair of asymmetrical actuators and wherein each actuator is moveable between an outer locked position, causing the bolt assembly to be locked, and an inner position where the asymmetrical actuators cooperate with a head to compress the dampening spring with respect to the bolt assembly.

12. The firearm of claim 11 including a firearm housing having a pair of asymmetrical actuator recesses for receiving the asymmetrical actuators.

13. The firearm of claim 12 wherein the head is interposed between the dampening spring and at least one of the asymmetrical actuators, the head including a generally curved contact surface for engaging at least one of the asymmetrical actuators when the actuators assume an inner position.

14. The firearm of claim 13 wherein the actuators assume the inner position in response to the movement of the bolt assembly such that the two actuators engage each other while only one of the actuators engage the head.

15. The firearm of claim 14 wherein the actuators comprise a pair of spherical objects.

16. The firearm of claim 15 wherein the energy absorbing mechanism at least partially biases the actuators towards a locked position where the actuators are seated within an actuator recess.

17. The firearm of claim 16 wherein the energy absorbing mechanism absorbs at least some initial portion of the energy associated with the firing.

18. The firearm of claim 17 wherein the actuators absorb at least some additional portion of the energy associated with the firing.

19. The firearm of claim 18 further comprising a recoil spring engaged with the bolt assembly and compressible relative to the movement of the bolt assembly and wherein the recoil spring is operative to absorb at least some additional portion of the energy associated with the firing.

20. The firearm of claim 1 wherein the actuator is normally seated within an actuator recess formed in the firearm housing, and wherein the dampening springs at least partially biases the actuator towards a locked position where the actuator is seated within the actuator recess.

* * * * *